United States Patent [19]

Frederick

[11] 4,404,790

[45] Sep. 20, 1983

[54] TRAVERSING CORE YARN GUIDE FOR SPINNING FRAMES

[75] Inventor: David C. Frederick, Gastonia, N.C.

[73] Assignee: Hope Plastics Corporation, Gastonia, N.C.

[21] Appl. No.: 272,477

[22] Filed: Jun. 11, 1981

[51] Int. Cl.[3] ..... D01H 13/04

[52] U.S. Cl. ..... 57/12; 57/352; 57/358

[58] Field of Search ..... 57/12, 352, 358, 361; 242/157 R

[56] References Cited

U.S. PATENT DOCUMENTS

| | | | |
|---|---|---|---|
| 2,171,826 | 9/1939 | Duraffourg | 242/157 R |
| 2,210,884 | 8/1940 | Chittenden et al. | 57/12 X |
| 3,092,953 | 6/1963 | Blackstock | 57/12 |
| 3,266,692 | 8/1966 | Whitten | 242/157 R X |
| 3,389,545 | 6/1968 | Grunder et al. | 57/12 |
| 3,444,677 | 5/1969 | Henry | 57/12 |
| 3,502,282 | 3/1970 | Graf | 242/157 R |

*Primary Examiner*—Donald Watkins

*Attorney, Agent, or Firm*—Harvey B. Jacobson

[57] ABSTRACT

A traversing core yarn guide for use on spinning frames mounts to an existing silver trumpet bar in a manner which allows the bar to be traversed, while the guide is provided with a hinge that allows it to be raised to a position which will not interfere with a concurrent raising of the top roll mechanism of the frame. The guide includes an interchangeable wing portion having yarn guiding inserts on its respective ends, such inserts being either of a ceramic, porcelain, pin or pulley construction.

12 Claims, 10 Drawing Figures

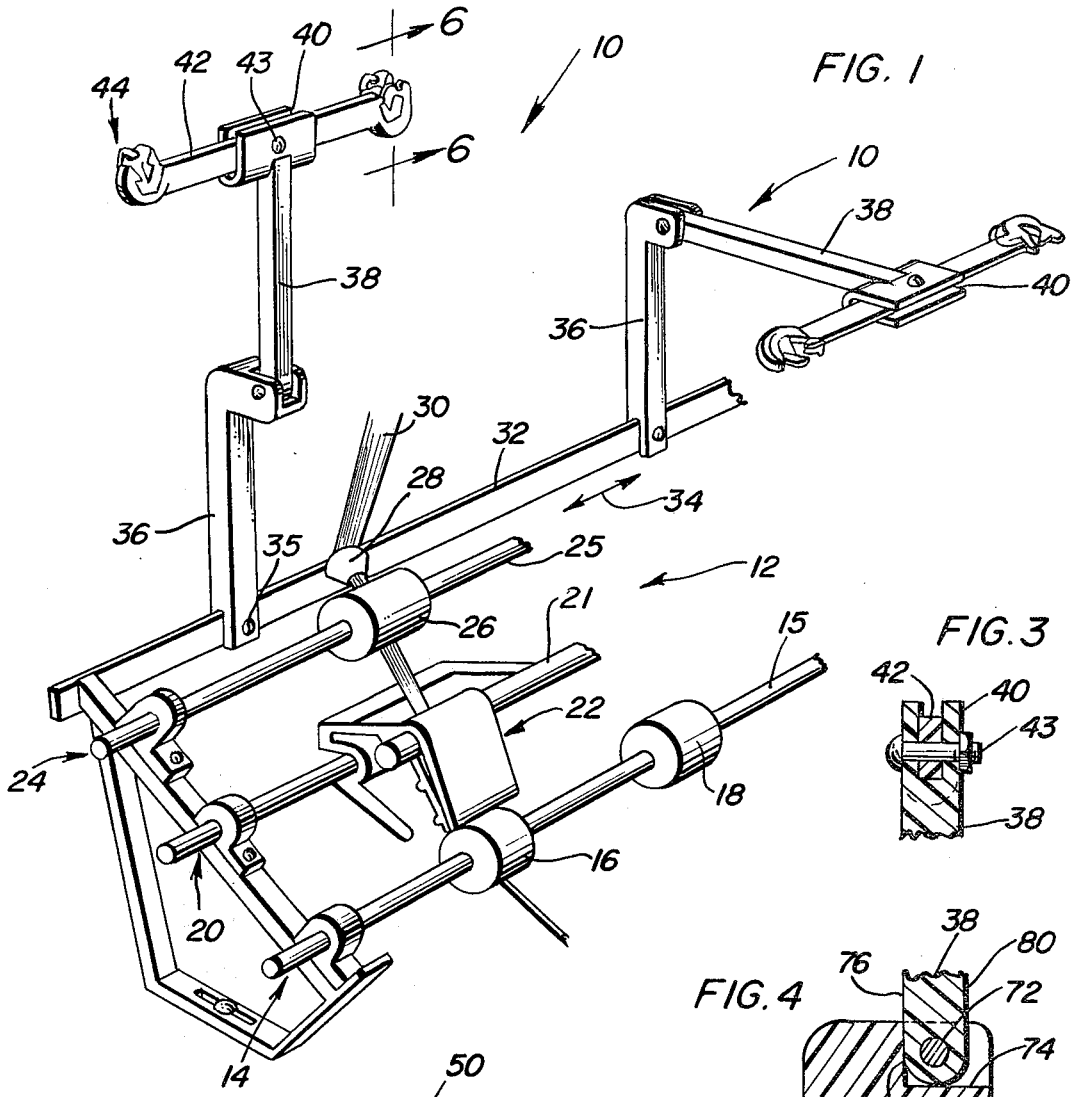
FIG. 1
10
6
6
40
42
43
44
38
36
30
28
32
34
35
25
12
21
26
15
22
24
18
16
20
14
FIG. 3
42
40
43
38
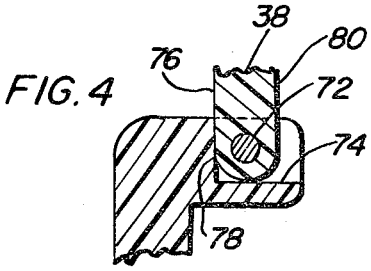
FIG. 4
38
80
76
72
74
78
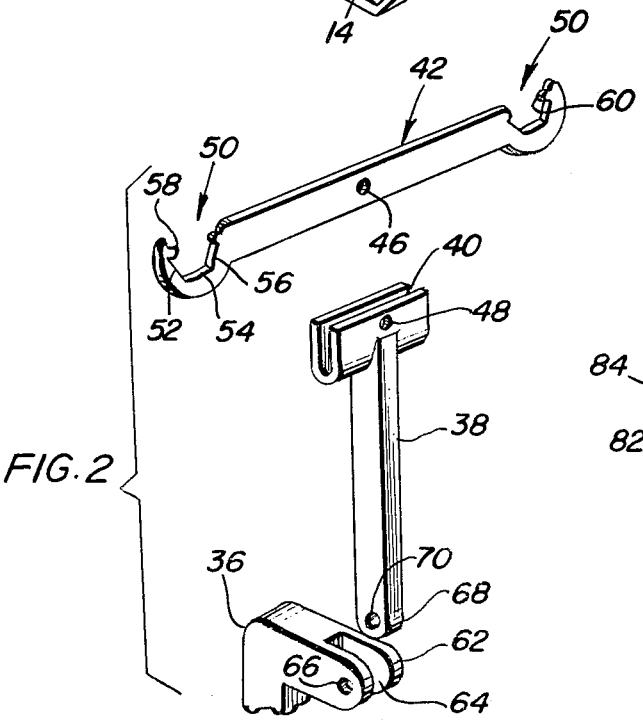
FIG. 2
50
42
60
50
58
46
40
56
52
54
48
38
36
70
68
62
66
64
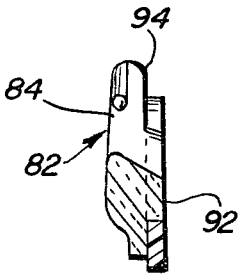
FIG. 6
94
84
82
92
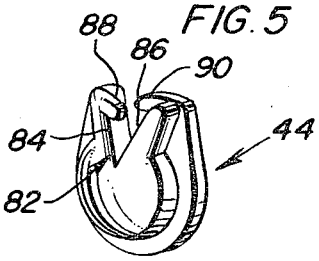
FIG. 5
88
86
90
84
44
82

40
42'
8
8
104
100
106
96
102
50'
98

104

100
102
98
42'

110
112
114

110
107
112
114
109
108
109

118
116

114
118
116
115

TRAVERSING CORE YARN GUIDE FOR SPINNING FRAMES

BACKGROUND OF THE INVENTION

1. Field of the Invention

The present invention relates generally to textile machinery, and more particularly to a machine known as a spinning frame having a novel and unique traversing core yarn guide incorporated thereon.

2. Description of the Prior Art

Spinning frames are well known in the art and need not be described in detail here. In such a machine, an intermediate stage of yarn known as "roving" is run through sets of rolls known collectively as a "drafting system" which serve to stretch or draft the fiber array, thereby to make a yarn which issues from the drafting system much longer than the roving which enters the same. As is well known, the act of lengthening or drafting the fiber array also results in compressing it in a lateral or transverse direction, so that the yarn issuing from the drafting system is not only much longer, but is also much thinner than the roving which is fed into the drafting system. In the spinning frame, the yarn then issuing from the drafting system may be spun or twisted, and subsequently wound on a bobbin.

Inasmuch as it can be appreciated that various means must be supplied on a spinning frame to guide the yarn in its various stages of production through the machine, there always exists a continuing need for improved guides for so directing the yarn. In this respect, there is a recognized need for a means to guide a yarn filament through a front draft zone in a manner which allows the fiber sliver to be spun around the filament after the fiber yarn has already passed through the rear and middle draft zones, and the present invention substantially fulfills this need.

SUMMARY OF THE INVENTION

The general purpose of the present invention, which will be described subsequently in greater detail, is to provide a core yarn guide for spinning frames that has all the advantages of the prior art core yarn guides and none of the disadvantages. To attain this, a traversing core yarn guide is provided which includes a first member fixedly securable to a sliver trumpet bar which forms a part of a spinning frame, and further includes a second member pivotally connected to the first member and movable through a 90° angle so as to be moved into and out of a core yarn guiding position. The second member is fixedly secured to a center portion of an orthogonally positioned wing member, such wing member having core yarn guiding inserts attached to opposed ends thereof. The inserts may be of a porcelain or ceramic construction, or alternatively, upwardly extending pins or pulleys may be employed to provide the core yarn guiding function.

It is therefore an object of the present invention to provide a traversing core yarn guide for spinning frames that is both simple in construction and limited in the number of moving parts, easily and economically manufactured, efficient and reliable in operation, useable in combination with any type of existing spinning frame, durable in construction and which may be easily maintained, and which may utilize selectively removable inserts for performing a core yarn guiding function.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view illustrating the traversing core yarn guide forming the present invention operably installed on a conventional spinning frame.

FIG. 2 is an exploded perspective view of a portion of the traversing core yarn guide for spinning frames which forms the present invention.

FIG. 3 is a sectional view illustrating the detachable connection between respective parts of the traversing core yarn guide forming the present invention.

FIG. 4 is a sectional view illustrating the hinged connection between respective parts of the invention.

FIG. 5 is a perspective view of a porcelain insert as may be utilized in combination with the present invention.

FIG. 6 is a transverse cross-sectional view of the porcelain insert operably installed on the wing of the present invention and as viewed along the line 6—6 of FIG. 1.

DESCRIPTION OF THE PREFERRED EMBODIMENTS

Figure 7:
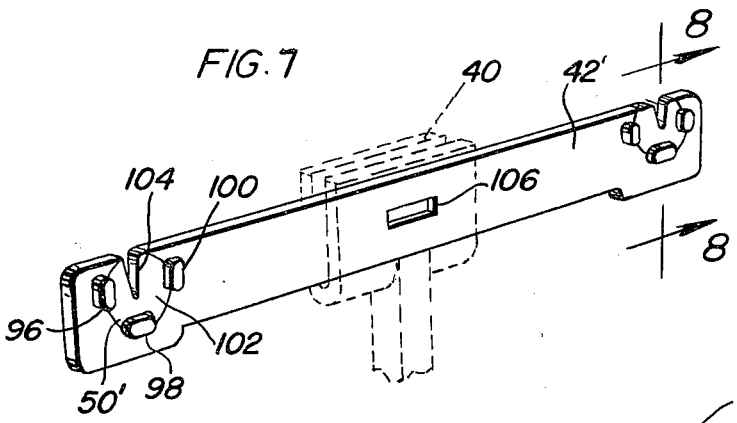
FIG. 7 is a perspective view illustrating the use of ceramic inserts operably installed on the wing forming a part of the present invention.

With reference now to the drawings and in particular to FIG. 1 thereof, a traversing core yarn guide for spinning frames embodying the principles and concepts of the present invention and generally designated by the reference numeral 10 will be described. In this respect, it can be seen that a conventional spinning frame 12 is illustrated, such spinning frame including a front draft zone 14 having a plurality of front top drafting rolls 16, 18 fixedly secured to a rotatable shaft 15, a middle draft zone 20 having a belt roller assembly 22 operably associated with rotatable shaft 21, and a back draft zone 24 having at least one back drafting roll 26 operably attached to rotatable shaft 25. Additionally, a trumpet 28 is illustrated through which roving or slivers 30 may be directed so as to be guided through the back drafting roll 26, the belt roller assembly 22 and the front top roll 16 in a conventional and well known manner. Additionally, a sliver trumpet bar 32 is illustrated, such trumpet bar being traversible back and forth in the direction 34 in a conventional manner.

Two traversing core guides 10 forming the present invention are shown operably, fixedly secured to the sliver trumpet bar 32 and in this respect, it can be seen that each traversing core guide includes a first upwardly extending member 36 which has a slotted lower end fixedly securable to the sliver trumpet bar 32 by a bolt type fastener, rivet or similar fastener 35 and a second longitudinal member 38 which is hingedly, pivotally connected to the free end of the first member. The second member 38 is provided with a slotted retaining bracket 40 on the remaining free end and a wing member 42 is fixedly secured within the bracket 40 by bolt 43 to enable assembly and disassembly of the wing member. Inserts 44 are positionable within the remote extending ends of the wing members 42 through which core yarn may be directed so as to properly position the same over the front top rolls 16, 18. In this regard, where the first and second members 36, 38, are in longitudinal alignment as shown in FIG. 1, the traversing core guide 10 is in an inoperative position, while where the first and second members 36, 38 are in an orthogonal aligned relationship, as also illustrated in FIG. 1, the traversing core guide is in its functionally operable position.

To obtain a further understanding of the particular construction of the present invention, reference is next made to FIGS. 2–3, wherein it can be seen that the wing member 42 is of a separable construction from the second member 38 and is attachable thereto through the use of apertures 46, 48, respectively contained in the wing member and the slotted retaining bracket 40 of the second member. In this regard, a conventional attachment means, such as a screw or the like 43, may then be conveniently inserted through the apertures 46, 48 once they are in coaxial alignment, thereby to effect the desired fixed securement between the wing member 42 and the second member 38. Additionally, it can be seen that the wing member 42 is provided with cutouts 50 on opposed ends thereof, such cutouts being of a configuration to receive the aforementioned inserts 44, which will be described subsequently in greater detail with reference to the further views of the drawings. As shown, the cutouts 50 may include a plurality of angulated planar sections 52, 54, 56 and may further include inwardly extending detents 58, 60 on respective sides of the cutouts.

Further illustrated in FIGS. 2 and 4 is the fact that the first member 36 includes an orthogonally extending section 62 having a slotted portion 64 contained in an end thereof and a through extending aperture 66 associated therewith. An end 68 of the second member 38 is then positionable within the slot 64, such end including a further through extending aperture 70 which is coaxially alignable with the aperture 66. A pin 72 may then be directed through the apertures 66, 70 to effect a hinged securement of the second member 38 to the first member 36 in a conventional and well known manner. Additionally, as most clearly illustrated in FIG. 4, the slot 64 includes a cross extending base portion 74 which serves to limit the extent of pivotal movement of the second member 38 relative to the first member 36. Effectively, as shown in FIG. 4, the second member 38 will be limited to 90° of arcuate travel inasmuch as a first edge 76 of the second member will come into contact with a wall 78 associated with the slot 64 when the second member is in an upwardly extending position, and a second edge 80 will come into contact with the base portion 74 when the second member is in an orthogonally aligned position relative to the longitudinal axis of the first member 36.

FIG. 5 illustrates one type of insert 44 which might be fixedly attached within the cutouts 50 associated with a wing member 42. In this regard, a porcelain insert 44 is illustrated, such insert being of a somewhat disc-shaped construction and including a smooth V-shaped slot 82 through which core yarn may be directed as desired. The V-shaped slot 82 includes a first surface 84 and a second surface 86, with the first surface 84 having a forwardly positioned outwardly extending detent 88 and the second surface 86 having a rearwardly positioned outwardly extending detent 90. As such, it can be appreciated that a length of core yarn may be conveniently directed between the detents 88, 90 whose respective ends overlap and once totally positioned within the slot 82, the detents 88, 90 serve to retain the yarn therein.

As shown in FIG. 6, a rear portion 92 of the porcelain insert 44 extends outwardly from a back surface 94 thereof, such rear portion 92 being selectively directable into a cutout 50 associated with one of the wing members 42 in a manner whereby the detents 58, 60 serve to lockably position the porcelain insert in position within the cutout. Additionally, if desired, glue or some other type of conventional attachment means may be utilized in combination with the inserts 44 to effectively retain the same within the cutouts 50.

Figure 8:
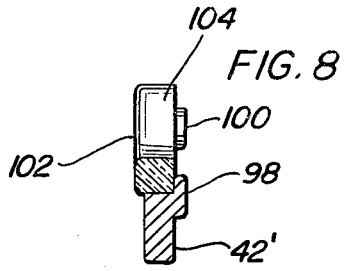
FIG. 8 is a transverse cross-sectional view of the ceramic inserts utilized in combination with the present invention as taken along the line 8—8 of FIG. 7.

FIG. 7 illustrates a modified embodiment of the wing member 42' whereby the aforementioned cutouts 50' are of a circuitous shape on the respective ends of the wing members, and wherein several retaining detents 96, 98, 100 may be employed to allow the effective positioning of a ceramic insert 102 within the cutout. In this regard, the ceramic insert 102 is of a disk-like construction and dispenses with the retaining detents 88, 90, in favor of an unobstructed V-shaped slot 104. As can be appreciated, the ceramic insert 102 may be positioned within the cutout 50' and effectively attached to the outwardly extending detents 96, 98, 100 by some conventional attachment means, such as through the use of glue, or the like. In this respect, FIG. 8 illustrates the manner in which the ceramic inserts 102 are abuttable against the detents 96, 98, 100 so that the aformentioned glueing may be effective thereby to retain the inserts in fixed securement with the wing member 42'.

FIG. 7 further illustrates a modification of the invention whereby aperture 48 in wing member 42' has been replaced by a slot 106 so as to permit a longitudinal adjustment of the wing member 42' relative to the slotted retaining bracket 40. In this regard, such a construction permits a more accurate alignment of the core yarn with respect to the front top rolls 16, 18 in a manner well understood by those familiar with the art.

Figure 9:
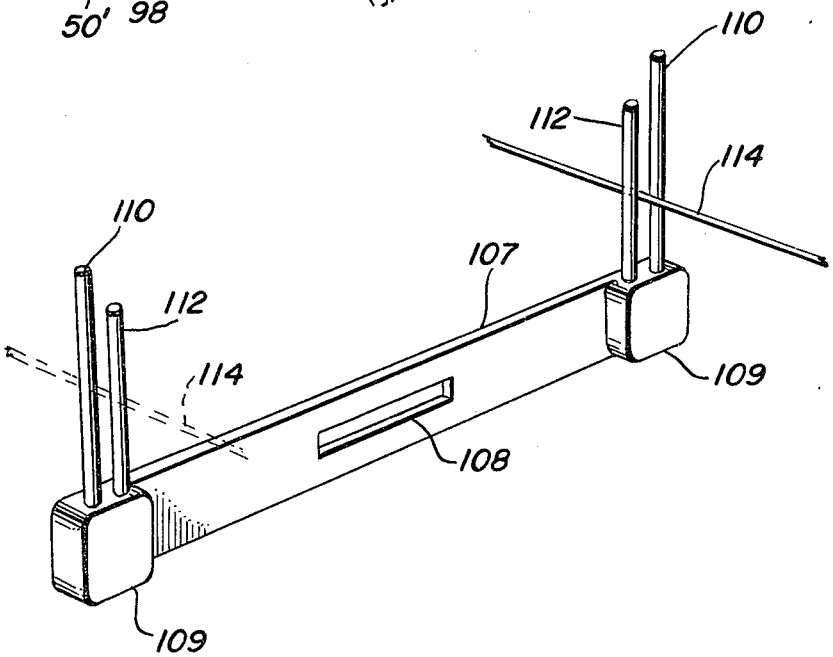
FIG. 9 is a perspective view illustrating pin type guides operably installed on the wing forming a part of the present invention.

FIG. 9 illustrates a further embodiment of the wing member designated by numeral 107 which has a central slot 108 and which dispenses with the cutouts 50 on respective ends of the wing member 42 and thickened end portions 109. A pair of upwardly extending pins 110, 112 are fixedly secured to each thickened portion 109. In this regard, the outermost pins 110 are illustrated as being of a somewhat greater length than the innermost pins 112 and as shown, core yarns 114 may be selectively directed between the pins 110, 112 so as to permit a guiding of the same through the aforementioned front top rolls 16, 18 in a desired manner. The greater lengths of pins 110 facilitate a positioning of the core yarns 114 thereagainst so as to guide the yarns downwardly into the spaces defined between the pins 110, 112.

Figure 10:
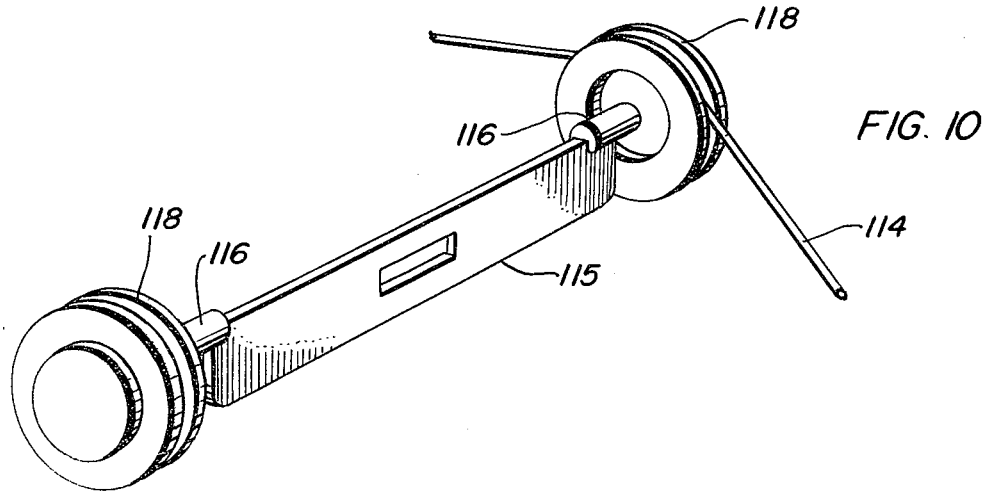
FIG. 10 is a perspective view illustrating pulley type guides operably installed on the wing forming a part of the present invention.

A final embodiment of the wing member is illustrated in FIG. 10 wherein it can be seen that the wing member 115 is provided with longitudinal extensions 116 on opposed ends thereof which are integral with the wing member 115 and of cylindrical construction so as to serve as axles or bearing support members for pulleys 118. In this connection, the pulleys 118 are fixedly, rotatably secured to the extensions 116 in a manner whereby the core yarn 114 may be directed over the pulleys in a manner so as to guide the same to the front top rolls 16, 18, as desired.

In effect, it can be appreciated that a hinged adjustable core yarn guide 10 has been described which has as its purpose to guide a filament yarn 114 through the front draft zone 14 of a spinning frame 12 in a manner that permits the fiber sliver to be spun around the filament after the fiber yarn has already passed through the back and middle draft zones 24, 20, respectively. In this regard, the traversing core yarn guide 10 mounts to the existing sliver trumpet bar 32 without affecting the conventional traversing action of the bar, and the hinged construction of the traversing core yarn guide allows it to be raised so as to not interfere with a raising of the top roll mechanism when desired. In operation, the core yarn 114 is directable through one of the plurality of different types of inserts, which include the porcelain inserts 44, the ceramic inserts 102, the pins 110, 112 or the pulleys 118, and is then directable down to the front top rolls 16, 18. The different inserts are provided to compensate for the particular conditions being experienced by the spinning frame and the type of yarn being woven, i.e., the inserts utilized depend upon the amount of loading experienced by the spinning frame 12 or the amount of lint buildup.

With respect to the above description then, it should be realized that the optimum dimensional relationships for the parts of the invention are deemed readily apparent and obvious to one who is skilled in the art to which the invention relates, and all equivalent relationships to those illustrated in the drawings and described in the specification, to include modification of form, size, arrangement of parts and details of operation, are intended to be encompassed by the present invention.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A core yarn guide for use on a spinning frame or the like, said guide comprising:

yarn guide means for guiding said core yarn;

first support means to which said yarn guide means is fixedly secured; and second support means to which said first support means is fixedly secured, said second support means being selectively attachable to said spinning frame, said second support means including a first arm and a second arm pivotally attached to said first arm, said first arm being fixedly securable to said spinning frame and said first support means being fixedly securable to said second arm, said first support means including an elongated member substantially orthogonally aligned with respect to said second arm and being connected to said second arm at a point which is substatially centrally positioned along a length of said elongated member.

2. The core yarn guide as defined in claim 1, and further wherein said yarn guide means is positioned at respective opposed ends of said elongated member.

3. The core yarn guide as defined in claim 2, wherein said second arm is provided with a slot into which said elongated member is positionable so as to effect an attachment therebetween.

4. The core yarn guide as defined in claim 3, wherein said elongated member is longitudinally adjustably positionable within said slot so as to permit a proper alignment of said yarn guide means relative to said spinning frame.

5. The core yarn guide as defined in claim 4, wherein said first arm is provided with travel limit means, said travel limit means serving to limit pivotal movement between said first arm and said second arm.

6. A core yarn guide for use on a spinning frame or the like, said guide comprising:

yarn guide means for guiding said core yarn;

first support means to which said yarn guide means is fixedly secured; and second support means to which said first support means is fixedly secured, said second support means being selectively attachable to said spinning frame, said yarn guide means including an elongated support member and at least one yarn guiding arrangement fixedly securable to said elongated support member, said at least one yarn guiding arrangement including an insert having a V-shaped slot through which said core yarn may be selectively guided, said V-shaped slot including first and second planar intersecting surfaces, said first surface having a topmost located forwardly positioned detent and said second surface having a topmost located rearwardly positioned detent, said forwardly and rearwardly positioned detents serving to retain a length of core yarn within said slot.

7. A core yarn guide for use on a spinning frame or the like, said guide comprising:

yarn guide means for guiding said core yarn;

first support means to which said yarn guide means is fixedly secured; and second support means to which said first support means is fixedly secured, said second support means being selectively attachable to said spinning frame, said yarn guide means including an elongated support member and at least one yarn guiding arrangement fixedly securable to said elongated support member, said at least one yarn guiding arrangement including a pair of upwardly extending pins between which said core yarn may be selectively guided, a first of said upwardly extending pins being of a length which exceeds a length of a second of said pins, so as to permit a positioning of said core yarn against said first pin prior to directing said yarn downwardly between said first and second pins.

8. A core yarn guide for use on a spinning frame or the like, said guide comprising:

a first support member fixedly securable to said spinning frame;

a second support member pivotally attached at one end thereof to said first support member and havng a retaining slot formed in its remaining free end;

a third support member retained within said retaining slot of said second support member and being substantially orthogonally aligned with respect to said second support member, said third support member being fixedly secured at substantially a central portion thereof within said retaining slot; and yarn guide means for guiding said core yarn fixedly attached to opposed respective ends of said third support member.

9. The core yarn guide as defined in claim 8, wherein said yarn guide means are retained within cutouts formed on respective ends of said third support member.

10. The core yarn guide as defined in claim 9, wherein said yarn guide means includes V-shaped slots through which said core yarn may be selectively guided.

11. The core yarn guide as defined in claim 8, wherein said yarn guide means includes outwardly extending pins attached to respective ends of said third support member, said core yarn being selectively directed between said pins.

12. The core yarn guide as defined in claim 8, wherein said yarn guide means includes pulleys fixedly, rotatably mounted to respective ends of said third support member, said core yarn being guidingly directed over said pulleys.

* * * * *